US010196249B2

(12) United States Patent
Pithoud et al.

(10) Patent No.: US 10,196,249 B2
(45) Date of Patent: Feb. 5, 2019

(54) COMPACT DEVICE FOR LIFTING A LOAD SECURED IN ORDER TO BE TRANSPORTED ON FORKS

(71) Applicant: HAULOTTE GROUP, L'Horme (FR)

(72) Inventors: Emmanuel Pithoud, Ste Marie de Cuines (FR); Jean-Charles Cain, La Talaudiere (FR); Slaheddine Beji, Vienne (FR)

(73) Assignee: HAULOTTE GROUP, L'Horme (FR)

( * ) Notice: Subject to any disclaimer, the term of this patent is extended or adjusted under 35 U.S.C. 154(b) by 0 days.

(21) Appl. No.: 15/532,917

(22) PCT Filed: Oct. 14, 2015

(86) PCT No.: PCT/EP2015/073768
§ 371 (c)(1),
(2) Date: Jun. 2, 2017

(87) PCT Pub. No.: WO2016/087103
PCT Pub. Date: Jun. 9, 2016

(65) Prior Publication Data

US 2017/0349420 A1 Dec. 7, 2017

(30) Foreign Application Priority Data

Dec. 4, 2014 (FR) ..... 14 61911

(51) Int. Cl.
*B66F 11/04* (2006.01)
*B66F 13/00* (2006.01)

(52) U.S. Cl.
CPC ..... *B66F 11/044* (2013.01); *B66F 13/00* (2013.01)

(58) Field of Classification Search
CPC ..... B66F 11/00; B66F 11/04; B66F 11/044; B66F 11/046; B66F 13/00
USPC ..... 414/711, 705, 685; 182/63.1
See application file for complete search history.

(56) References Cited

U.S. PATENT DOCUMENTS 3,085,648 A * 4/1963 Di Benedetto ..... B66F 11/044 182/2.9
3,095,945 A * 7/1963 Mitchell ..... B66F 11/04 182/14
3,438,669 A * 4/1969 Vik ..... B66F 9/184 294/90
3,584,705 A 6/1971 Ruegg
(Continued)

FOREIGN PATENT DOCUMENTS

CN 1195639 A 10/1998
CN 104051968 A 9/2014
(Continued)

OTHER PUBLICATIONS

International Search Report, dated Nov. 19, 2015, from corresponding PCT application.

*Primary Examiner* — Katherine W Mitchell
*Assistant Examiner* — Shiref M Mekhaeil
(74) *Attorney, Agent, or Firm* — Young & Thompson

(57) ABSTRACT

A lifting device includes a chassis, a turret connected to the chassis so as to rotate around a vertical axis, and a lifting arm, extending between a first end connected to the turret, and a second end connected to a unit for carrying the load. It includes a first sleeve and a second sleeve, each able to receive a respective fork, arranged on the chassis, on either side of the turret, parallel to one another.

11 Claims, 4 Drawing Sheets

(56) References Cited

U.S. PATENT DOCUMENTS 3,643,825 A * 2/1972 Zane, Jr. ..... B66F 9/183 414/607
3,757,977 A * 9/1973 Brudi ..... B66F 9/10 294/87.22
D283,072 S * 3/1986 Qureshi ..... 182/2.1
4,775,029 A 10/1988 Macdonald et al.
4,979,588 A * 12/1990 Pike ..... B66C 15/06 182/18
5,584,356 A * 12/1996 Goodrich ..... B66F 11/046 182/63.1
6,024,191 A * 2/2000 Backer ..... B66F 11/046 182/141
7,922,438 B2 * 4/2011 McKee ..... E02F 3/28 37/403
8,075,241 B2 * 12/2011 McKee ..... E02F 3/964 37/403
9,505,454 B1 * 11/2016 Kautsch ..... B62D 55/104
D778,022 S * 1/2017 Sauvaget ..... D34/33
2006/0219478 A1 * 10/2006 Severs ..... B66F 11/044 182/2.9
2007/0144832 A1 * 6/2007 Cresswell ..... E04G 1/24 182/127
2013/0087410 A1 * 4/2013 Bowden ..... B66F 11/044 182/63.1
2013/0087411 A1 * 4/2013 Shade ..... B60K 7/0015 182/63.1
2013/0153333 A1 * 6/2013 Richards ..... B66F 11/044 182/18
2016/0090710 A1 * 3/2016 Takemura ..... E02F 3/34 414/685
2017/0291805 A1 * 10/2017 Hao ..... B60P 1/34

FOREIGN PATENT DOCUMENTS

CN 203819662 U 9/2014
EP 0 856 487 A2 8/1998
EP 1 153 880 A1 11/2001

* cited by examiner

COMPACT DEVICE FOR LIFTING A LOAD SECURED IN ORDER TO BE TRANSPORTED ON FORKS

BACKGROUND OF THE INVENTION

Field of the Invention

The present invention relates to a compact device for lifting a load, also called lifting machine.

Description of Related Art

Such a lifting device includes a chassis, typically mounted on wheels, a turret connected to the chassis so as to rotate around a vertical axis, and a lifting arm, extending between a first end connected to said turret, and a second end supporting means for carrying the load, for example a platform. This lifting device allows both the lifting and rotation of the carrying means around the vertical axis.

The lifting device is described as "compact" when its chassis has a height, considered in the direction of the vertical axis, a wheelbase, i.e., the distance between its axles, and a track width, i.e., the distance between the wheels of a same axle, that are all relatively small. More particularly, the lifting device is described as compact when the height of the chassis is smaller than 0.7 m, the wheelbase is smaller than 1.7 m and the track width is smaller than 1.2 m.

Such a compact lifting device is typically used on a trailer to be transported from one usage site to another. However, this lifting device has a limited crossing capacity, not making it possible to mount such a trailer alone, the access ramp of which is not suitable and is too steep. It is then generally necessary to arrange the compact lifting device in the trailer using a larger, outside lifting vehicle. More particularly, such an outside lifting vehicle typically includes lifting forks, which are inserted below the chassis of the lifting device to lift the latter for transport thereof. The outside lifting vehicle can even be used in case of breakdown of the compact lifting device, for example to bring it close to a power recharging point.

However, the balance of such a lifting device is not optimized for such transport on forks, such that there are risks of this lifting device falling during transport.

SUMMARY OF THE INVENTION

The invention in particular aims to resolve this drawback by securing the transport of such a compact lifting device with a turret, on forks.

To that end, the invention in particular relates to a device for lifting a load, including:

- a chassis, mounted on moving support means, extending longitudinally along a longitudinal direction, and transversely along a transverse direction perpendicular to the longitudinal direction,
- a turret, connected to the chassis so as to rotate around a vertical axis perpendicular to the longitudinal direction and the transverse direction,
- a lifting arm, extending between a first end connected to the turret, and a second end connected to means for carrying the load, characterized in that it includes a first sleeve and a second sleeve, each able to receive a respective fork, arranged on the chassis, on either side of the turret, parallel to one another.

In order to transport this lifting device, the forks of an outside lifting vehicle are each inserted into one of the first and second respective sleeves. The forks are therefore kept in the sleeves, which prevents any tilting of the lifting device around an axis parallel or perpendicular to these forks. The lifting device is therefore correctly maintained on these forks, thereby eliminating any fall risks.

Advantageously, the sleeves are positioned at a small distance from the ground to facilitate handling maneuvers.

It should be noted that, for a compact lifting device, the space necessary to arrange the first sleeve and the second sleeve on the chassis is generally reduced. In particular, the rotation of the turret is controlled by a bulky crown and gear system housed in the chassis, and it requires fitting guides for the power cables and hydraulic hoses, so that they are not stretched or damaged by the rotation of the turret. All of these elements are particularly bulky, such that it is difficult to arrange the sleeves on the chassis.

Furthermore, the chassis includes, above the front axle of the lifting device, a mechanism for steering the wheels, such that this space is not available to arrange a sleeve therein. It should be noted that arranging a sleeve above this wheel steering mechanism would not be a satisfactory solution, since the sleeve would then be too high.

Indeed, to facilitate handling maneuvers, it is preferable for the sleeves to be positioned at the smallest possible distance from the ground.

Advantageously, in order to resolve these drawbacks, at least one of the first and second sleeves has a central undercut emerging across from the turret, and the turret includes at least one indentation, such that the indentation coincides with the undercut in at least a first angular position of the turret, such that the sleeve is free to receive a fork.

Owing to the undercut, the turret can rotate around its vertical axis in this undercut, therefore without being bothered by the corresponding sleeve. This sleeve can therefore be positioned extremely close to this turret.

Furthermore, owing to the indentation, one ensures that, in at least one angular position of the turret, the passage of a fork through this sleeve is authorized. In other words, to transport the lifting device, the turret is placed in its first angular position, such that the fork can be inserted into the sleeve, while entering the free space formed by the indentation.

Advantageously, a lifting device according to the invention may comprise one or more of the following features, considered alone or in any technically possible combinations.

- In at least one second angular position of the turret, this turret extends partially in the undercut, closing off the sleeve.
- The turret bears a counterweight member arranged opposite the lifting arm perpendicular to the vertical direction, the indentation being arranged between the counterweight member and the chassis.
- The turret is provided with a protective belt, surrounding the turret at the same height as the indentation along the vertical axis.
- The first and second sleeves are arranged on either side of the turret in the transverse direction, each sleeve extending parallel to the longitudinal direction.
- The first and second sleeves are arranged on either side of the turret in the longitudinal direction, each sleeve extending parallel to the transverse direction.
- The moving support means comprise front and rear axles, each bearing two wheels, each axle extending parallel to the transverse direction, each of the first and second receiving sleeves being arranged between the front and rear axles in the longitudinal direction.

The front and rear axles are spaced apart in the longitudinal direction by a distance smaller than 1.7 meters, and/or the wheels of each front and rear axle are spaced apart in the transverse direction by a distance smaller than 1.2 meters.

At least one of the first and second sleeves includes two arches arranged across from one another, spaced apart.

The first and second sleeves being arranged on the chassis at a first height relative to a bearing surface of the moving support means, the chassis includes at least one element arranged at a second height relative to the bearing surface, said second height being greater than or equal to the first height.

BRIEF DESCRIPTION OF DRAWINGS

The invention will be better understood upon reading the following description, provided solely as an example and done in reference to the appended figures, in which.

DETAILED DESCRIPTION

Figure 1:
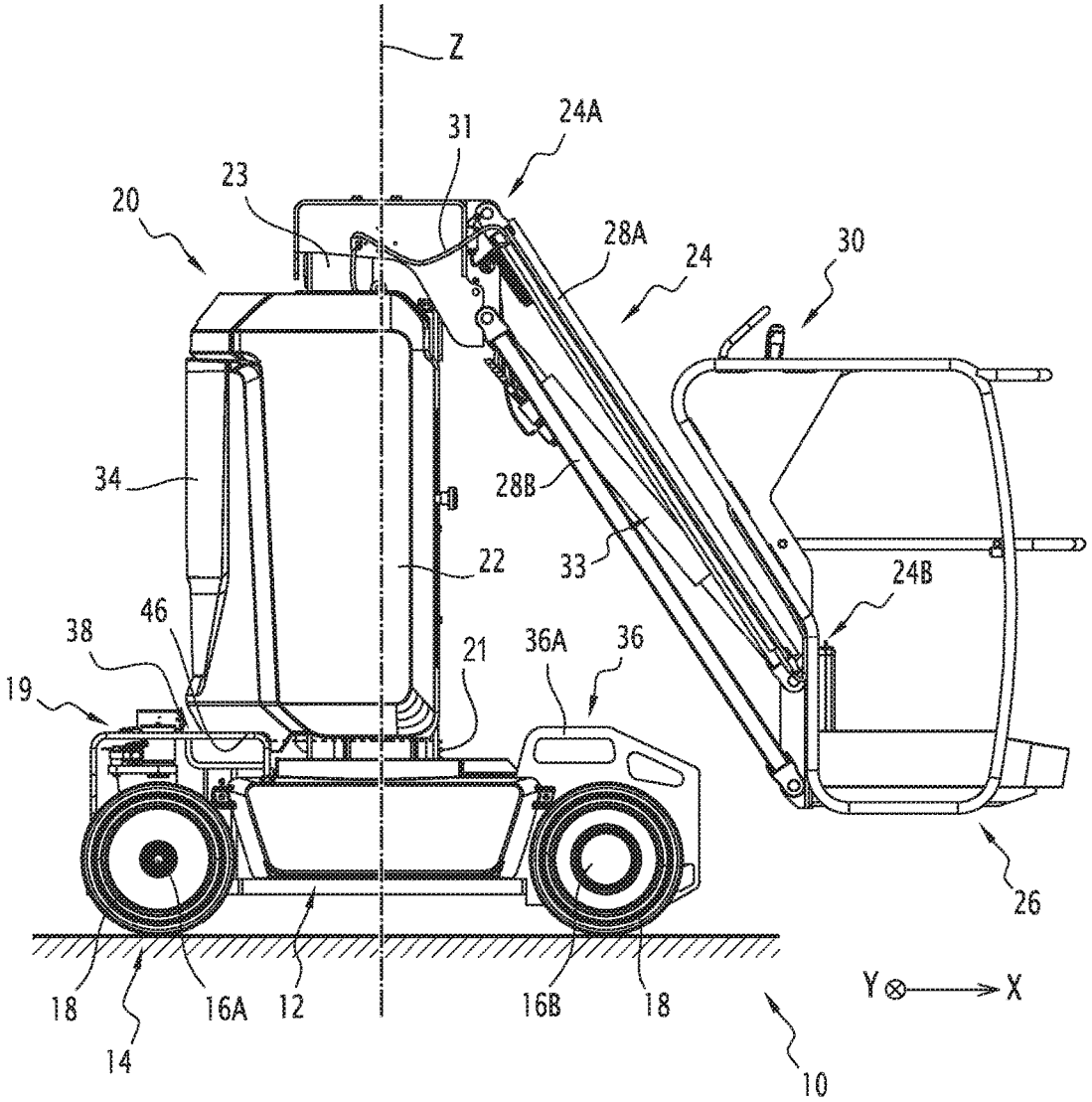
FIG. 1 is a profile view of a compact lifting device according to one example embodiment of the invention.

The figures show a device 10 for lifting a load, for example for lifting a person.

The lifting device 10 includes a chassis 12, mounted on moving support means 14. This chassis 12 extends longitudinally along a longitudinal direction X, and transversely along a transverse direction Y perpendicular to the longitudinal direction X.

The moving support means 14 for example include front 16A and rear 16B axles, each extending parallel to the transverse direction Y. Each front 16A and rear 16B axle bears a wheel 18 at each of its ends in the transverse direction Y.

The lifting device 10 is of the compact type, i.e., its wheelbase, in other words the distance between the front 16A and rear 16B axles, is smaller than 1.7 m, and its track width, in other words the distance between the wheels 18 of a same axle, is smaller than 1.2 m.

Furthermore, considering a vertical axis Z perpendicular to the longitudinal X and transverse Y directions, the height of the chassis 12, considered in a vertical direction parallel to the axis Z, is smaller than 0.7 m.

The chassis 12 includes a mechanism 19 for steering the wheels 18, arranged above the front axle 16A of the lifting device 10.

The lifting device 10 further includes a turret 20, connected to the chassis 12 so as to rotate around a vertical axis Z. This turret 20 includes a cover 22 housing operating components of this turret 20, in particular electronic components, a hydraulic tank, batteries, power cables, and/or rigid and/or flexible pipes for transporting fluid.

Means for rotating the turret 20 around the vertical axis Z are housed in the chassis 12. The chassis 12 also houses means for steering the moving support means 14, making it possible to move the lifting device 10. These driving means and steering means are traditional, and will therefore not be described in more detail.

The lifting device 10 includes a vertical arm 23, preferably telescoping, movable vertically between a position retracted in the turret 20 (shown in FIG. 1) and a deployed position. The lifting device 10 also includes a lifting arm 24, extending between a first end 24A connected to the vertical arm 23, and a second end 24B connected to means 26 for carrying the load, for example a traditional-type platform.

In the described example, the lifting arm 24 is connected to the vertical arm 23 by an articulation, and it can rotate around this articulation, while keeping the platform 26 horizontal. For example, the lifting arm 24 traditionally includes two beams 28A, 28B that are parallel to one another, each connected, at the first end 24A, to the vertical arm 23 by a first pivot link with an axis perpendicular to the vertical axis Z, and connected, at the second end 24B, to the platform 26 by a second pivot link with an axis parallel to that of the first pivot link.

Thus, the platform 26 can be moved heightwise, on the one hand by deploying the vertical arm 23, and on the other hand by rotating the lifting arm 24 around its articulation with this vertical arm 23.

Traditionally, the platform 26 includes means 30 for controlling the lifting device 10, connected to the operating components housed in the turret 20, and the driving means and steering means housed in the chassis 12, by cables 31 in particular entering the lifting arm 24. The operation of these control means 30 is traditional, and will therefore not be described in more detail.

Alternatively, the lifting arm 24 can be of any other known type.

Furthermore, the lifting device 10 includes traditional means for moving the lifting arm 24, for example hydraulic means 33 able to rotate this arm 24 around the articulation of its first end 24A.

Advantageously, the turret 20 includes a counterweight member 34, arranged opposite the lifting arm 24, perpendicular to the vertical direction Z. This counterweight member 34 makes it possible to avoid an imbalance of the lifting device 10 when the lever arm between the platform 26 and the turret 20 is significant, and the platform 26 is carrying a load.

In order to avoid an imbalance, generally due to this counterweight member 34, during the transport of the lifting device 10 by an outside lifting vehicle, the lifting device 10 includes first 36 and second 38 sleeves, each able to receive a respective fork of said outside lifting vehicle.

The first 36 and second 38 sleeves are arranged on top of the chassis 12 in the direction of the vertical axis Z, on either side of the turret 20, one parallel to the other.

A "sleeve" refers to any hollow member allowing the insertion of a lifting fork, for the transport of the device 10.

In the described example, the first 36 and second 38 sleeves are arranged on either side of the turret 20 in the longitudinal direction X.

According to an alternative that is not shown, these first and second sleeves could be arranged on either side of the turret 20 in the transverse direction Y.

The first 36 and second 38 sleeves are arranged on the chassis 12 at a first height relative to a bearing surface of the wheels 18, the chassis 12 including at least one element arranged at a second height relative to the bearing surface, such that said second height is greater than or equal to the first height. In other words, the height of the sleeves 36, 38 does not exceed the height of the chassis 12. In the described example, said element arranged at the second height is an element of the means 19 for steering the wheels.

Figure 2:
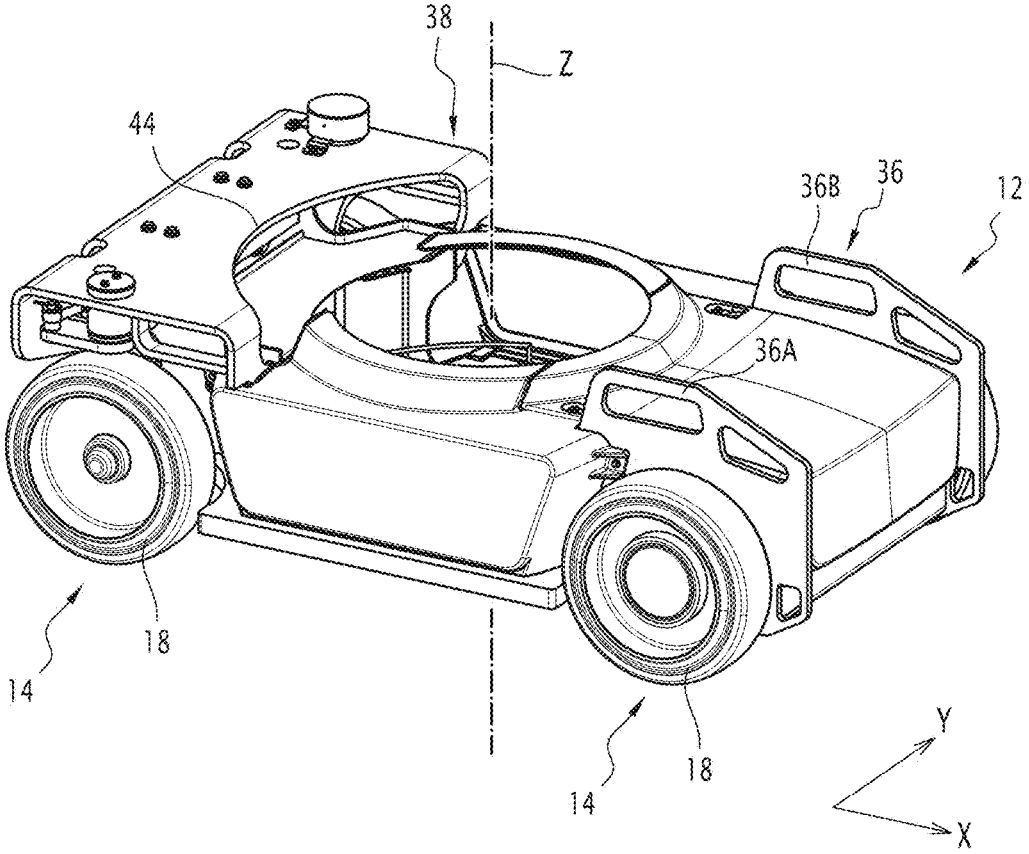
FIG. 2 is a perspective view of the lifting device of FIG. 1, the turret of which is not shown for clarity reasons.

As in particular shown in FIG. 2, the first sleeve 36 includes, in the described example, two arches 36A, 36B for receiving forks, arranged across from one another, and spaced apart from one another.

Figure 3:
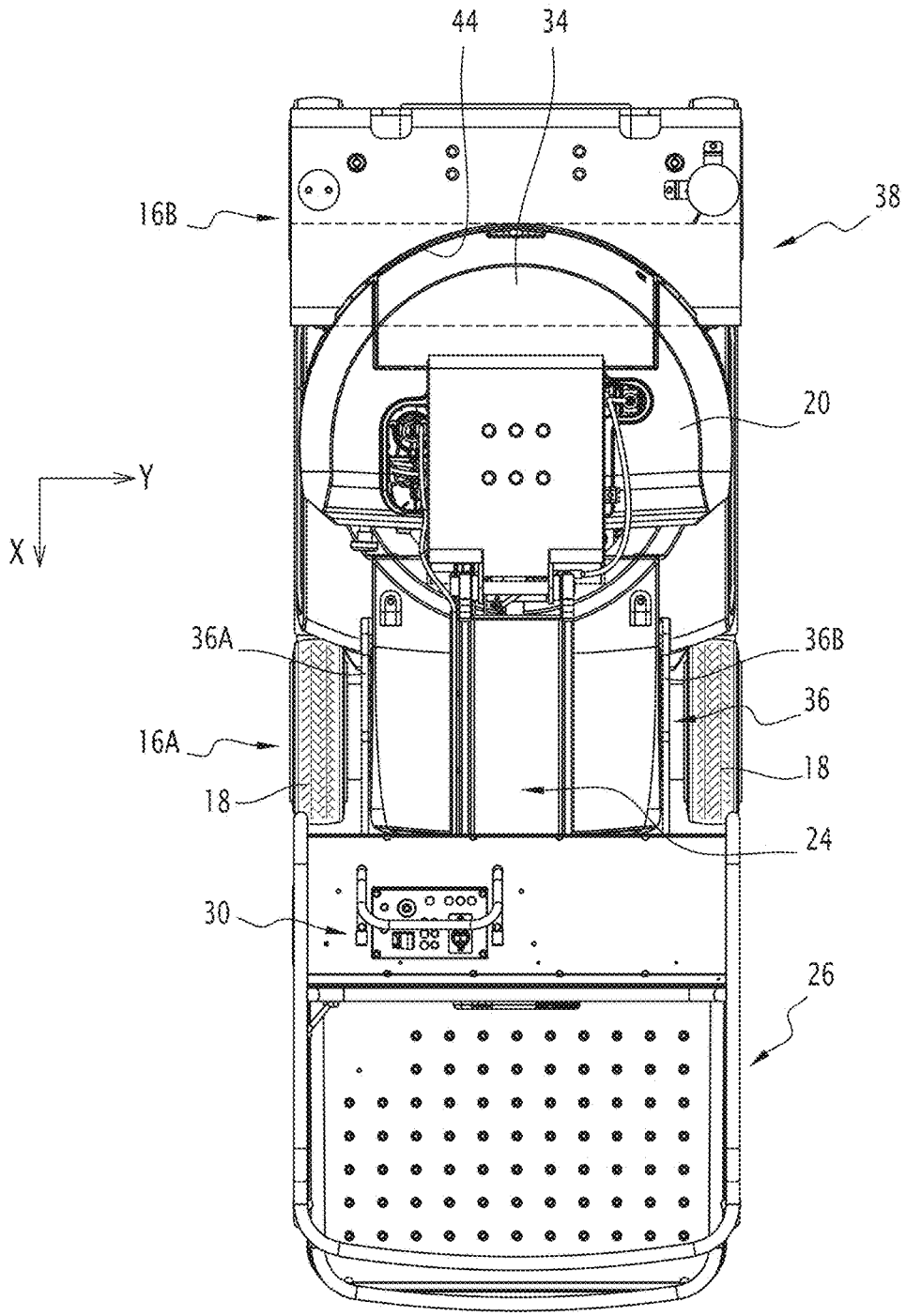
FIG. 3 is a top view of the lifting device of FIG. 1, the turret of which is shown in a first angular position.
Figure 4:
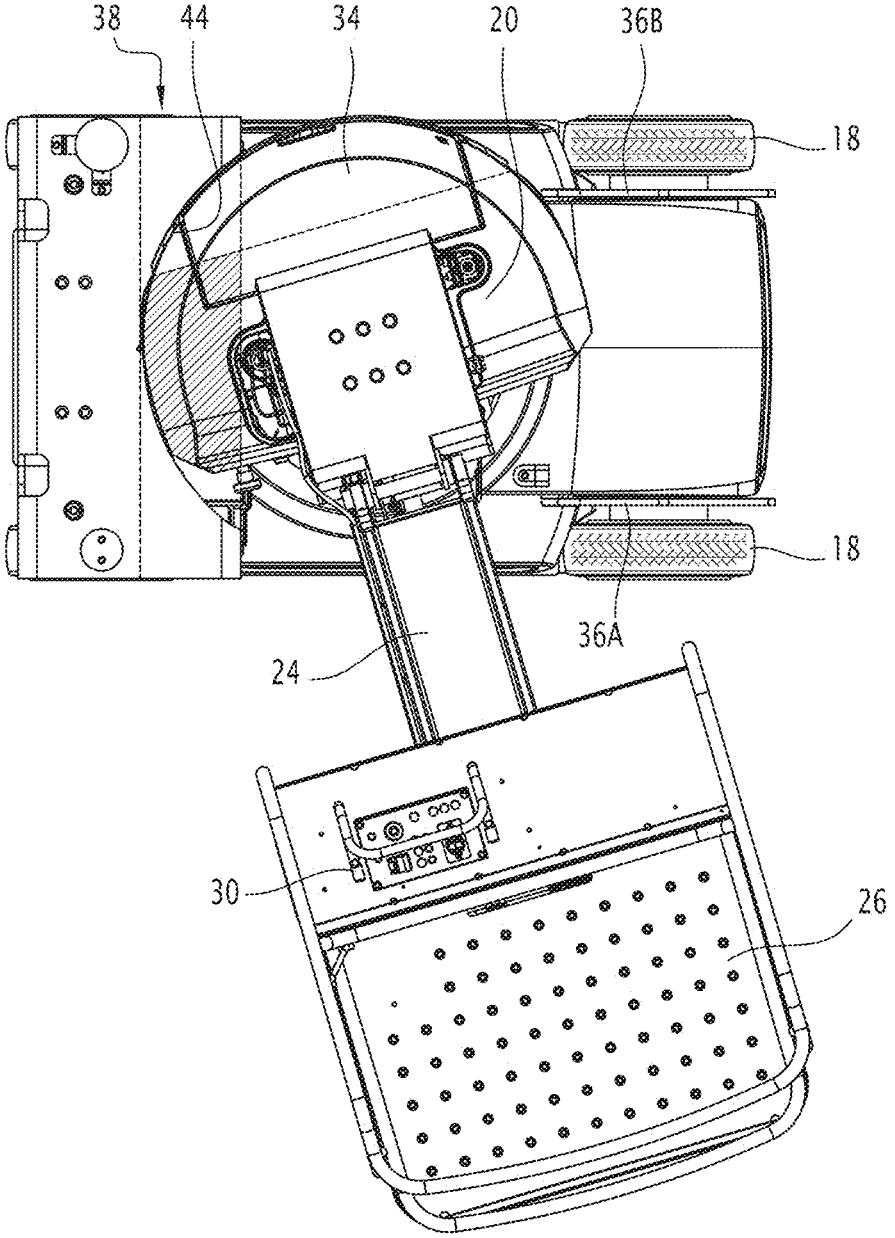
FIG. 4 is a top view of the lifting device of FIG. 1, the turret of which is shown in a second angular position.

Furthermore, the second sleeve 38 forms an elongate hollow crosspiece, including a central undercut 44, shown in FIGS. 2 to 4, emerging across from the turret 20, more particularly emerging both in the longitudinal direction X and in the direction of the vertical axis Z, such that the turret 20 extends partly in this central undercut 44. Thus, owing to this central undercut 44, the second sleeve 38 can be arranged extremely close to the turret 20, such that this second sleeve 38 can be arranged on the chassis 12 despite the compactness of the lifting device 10.

Each of the first 36 and second 38 receiving sleeves is arranged between the front 16A and rear 16B axles in the longitudinal direction X. The distance between the first 36 and second 38 sleeves is a predetermined distance, equal to the distance between the forks of said outside lifting vehicle intended to transport the lifting device 10.

As previously indicated, due to the compactness of the lifting device 10 and the bulk of the turret 20, this turret 20 extends in the undercut 44 of the second sleeve 38. However, it is necessary to allow the passage of a fork in the second sleeve 38.

To that end, the turret 20 includes at least one indentation 46, defining a free space, coinciding with the undercut 44 in at least a first angular position of the turret 20, which is for example the position shown in FIGS. 1 and 3, i.e., the position in which the lifting arm 24 extends parallel to the longitudinal direction X, in front of the lifting device 10. Thus, in this first angular position of the turret 20, the second sleeve 38 is free to receive a fork. The free passage arranged in the second sleeve 38 is shown in dotted lines in FIG. 3.

However, in a second angular position of the turret 20, in particular that shown in FIG. 4, the indentation 46 does not coincide with the undercut 44, such that the second sleeve 38 is obstructed by the turret 20. The part of the turret 20 obstructing the passage in the second sleeve 38 is shown crosshatched in FIG. 4.

In the illustrated example, the turret 20 shows only one angular position in which the second sleeve 38 is free, this second sleeve 38 being obstructed by the turret 20 in any other angular position of the turret 20 different from said first position.

For example, the undercut 46 is arranged below the counterweight member 34, i.e., between this counterweight member 34 and the chassis 12.

Advantageously, the turret 20 includes a protective belt 21 shown schematically in broken line in FIG. 1, surrounding this turret 20 at the same height as the undercut 46. Thus, if one were to try to insert a fork into the second sleeve 38 while the turret 20 is not in its first angular position, this fork would come into contact with this protective belt 21, and would therefore not damage the turret 20.

Furthermore, preferably, the operating components of this turret 20 are not at the height of the undercut 46, so as not to risk being damaged by a fork 42.

It will be noted that the invention is not limited to the described embodiment, but could assume various alternatives.

The invention claimed is:

1. A compact lifting device for lifting a load, including:

a chassis, mounted on a moving support, extending longitudinally along a longitudinal direction, and transversely along a transverse direction perpendicular to the longitudinal direction, a turret, connected to the chassis so as to rotate around a vertical axis perpendicular to the longitudinal direction and the transverse direction, a lifting arm, extending between a first end connected to the turret, and a second end connected to a carrier for carrying the load, wherein said compact lifting device includes a first sleeve and a second sleeve parallel to said first sleeve, each sleeve able to receive a respective fork, said first sleeve and said second sleeve are arranged on the chassis, on either side of the turret respectively; and wherein at least one of the first and second sleeves has a central undercut emerging across from the turret, and the turret includes at least one indentation, such that the indentation coincides with the undercut in at least a first angular position of the turret, such that said one of the first and second sleeves is free to receive said respective fork.

2. The compact lifting device according to claim 1, wherein, in at least one second angular position of the turret, said turret extends partially in the undercut, closing off said one of the first (36) and second (38) sleeves.

3. The compact lifting device according to claim 1, wherein the turret (20) bears a counterweight member arranged opposite the lifting arm perpendicular to the vertical direction, the indentation being arranged between the counterweight member and the chassis.

4. The compact lifting device according to claim 1, wherein the turret is provided with a protective belt, surrounding the turret at the same height as the indentation along the vertical axis.

5. The compact lifting device according to claim 1, wherein the first and second sleeves are arranged on either side of the turret in the longitudinal direction, each first and second sleeve extending parallel to the transverse direction.

6. The compact lifting device according to claim 5, wherein the moving support comprise front and rear axles, each bearing two wheels, each front and rear axle extending parallel to the transverse direction, each of the first and second sleeves being arranged between the front and rear axles in the longitudinal direction.

7. The compact lifting device according to claim 6, wherein the front and rear axles are spaced apart in the longitudinal direction by a distance smaller than 1.7 meters.

8. The compact lifting device according to claim 7, wherein the wheels of each front and rear axle are spaced apart in the transverse direction by a distance smaller than 1.2 meters.

9. The compact lifting device according to claim 6, wherein the wheels of each front and rear axle are spaced apart in the transverse direction by a distance smaller than 1.2 meters.

10. The compact lifting device according to claim 1, wherein at least one of the first and second sleeves includes two arches arranged across from one another, spaced apart.

11. The compact lifting device according to claim 1, wherein, the first and second sleeves being arranged on the chassis at a first height relative to a bearing surface of the moving support, the chassis includes at least one element arranged at a second height relative to the bearing surface, said second height being greater than or equal to the first height.

* * * * *